United States Patent [19]

Van Grouw

[11] 4,121,506

[45] Oct. 24, 1978

[54] CARTON FORMING APPARATUS

[75] Inventor: John Van Grouw, Franklin Lakes, N.J.

[73] Assignee: The Continental Group, Inc., New York, N.Y.

[21] Appl. No.: 780,487

[22] Filed: Mar. 23, 1977

[51] Int. Cl.[2] ..... B31B 1/36

[52] U.S. Cl. ..... 93/52

[58] Field of Search ..... 93/52, 49 R, 48, 61 R

[56] References Cited

U.S. PATENT DOCUMENTS

| | | | |
|---|---|---|---|
| 1,123,945 | 1/1915 | Staude | 93/52 |
| 3,270,628 | 9/1966 | Clem | 93/52 |
| 3,371,585 | 3/1968 | Moser et al. | 93/52 |
| 3,626,660 | 12/1971 | Dorfmann | 93/52 X |
| 3,808,958 | 5/1974 | Keener et al. | 93/49 R |
| 4,012,996 | 3/1977 | Stolkin et al. | 93/49 R X |

*Primary Examiner*—James F. Coan

*Attorney, Agent, or Firm*—Charles E. Brown

[57] ABSTRACT

This disclosure relates to a carton forming apparatus particularly adapted to receive a carton blank intended to be folded into a carton having a sleeve along one edge thereof, the carton forming apparatus being of a construction providing for automatic operation thereof throughout. The apparatus includes automatic feed mechanisms, cooperating blade and plow devices for effecting a folding of an edge flap, combination folder and retainer apparatus for folding a next adjacent carton panel while retaining the folded flap in its folded state, and an adhesive applying device for applying adhesive to the carton blank in alignment with the folded position of the edge flap for bonding the edge flap to the main portion of the carton. The plow and blade devices are mounted for adjustment to accommodate carton blanks with different edge flap widths. The folder and retainer devices are formed in sections and readily removable from the apparatus. The apparatus also includes a takeaway conveyor arrangement including overhead conveyors, one of which is mounted for upwardly movement to an out of the way position and the other of which has disks for engaging in the portions of a carton in compressive relation.

14 Claims, 26 Drawing Figures

219
215

220
215
30

31
30
32

13
13
38
40
46
44
(d)
(c)
(b)
(a)
45
33
37

35
34
42
43
33
44
37
36
40
41
38

FIG. 17
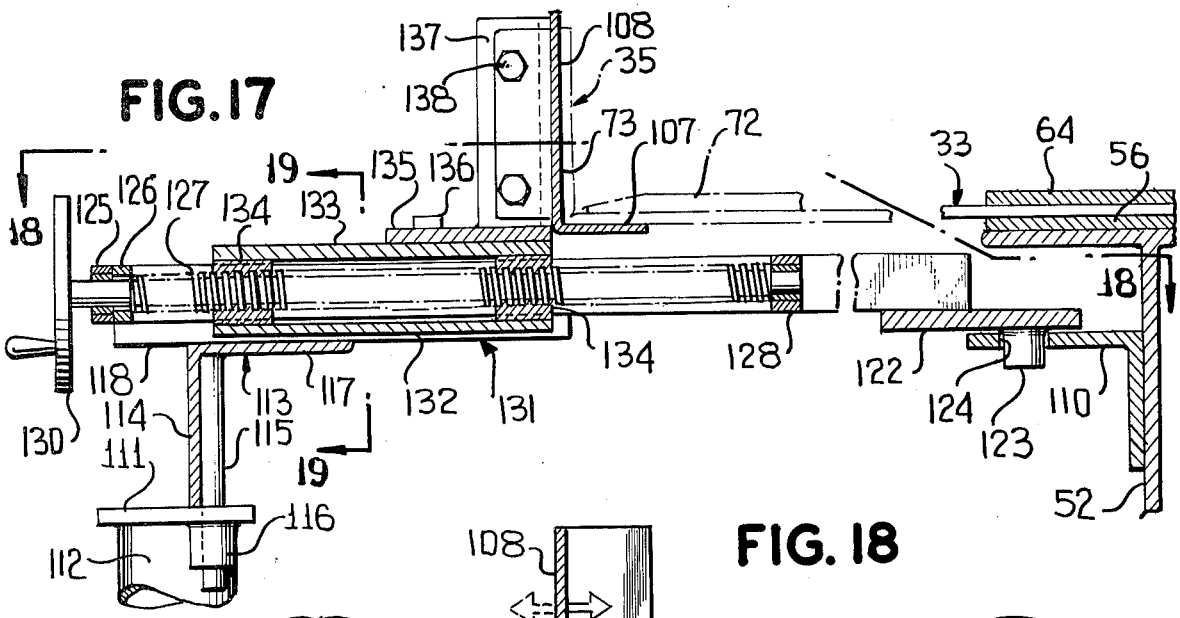
FIG. 18
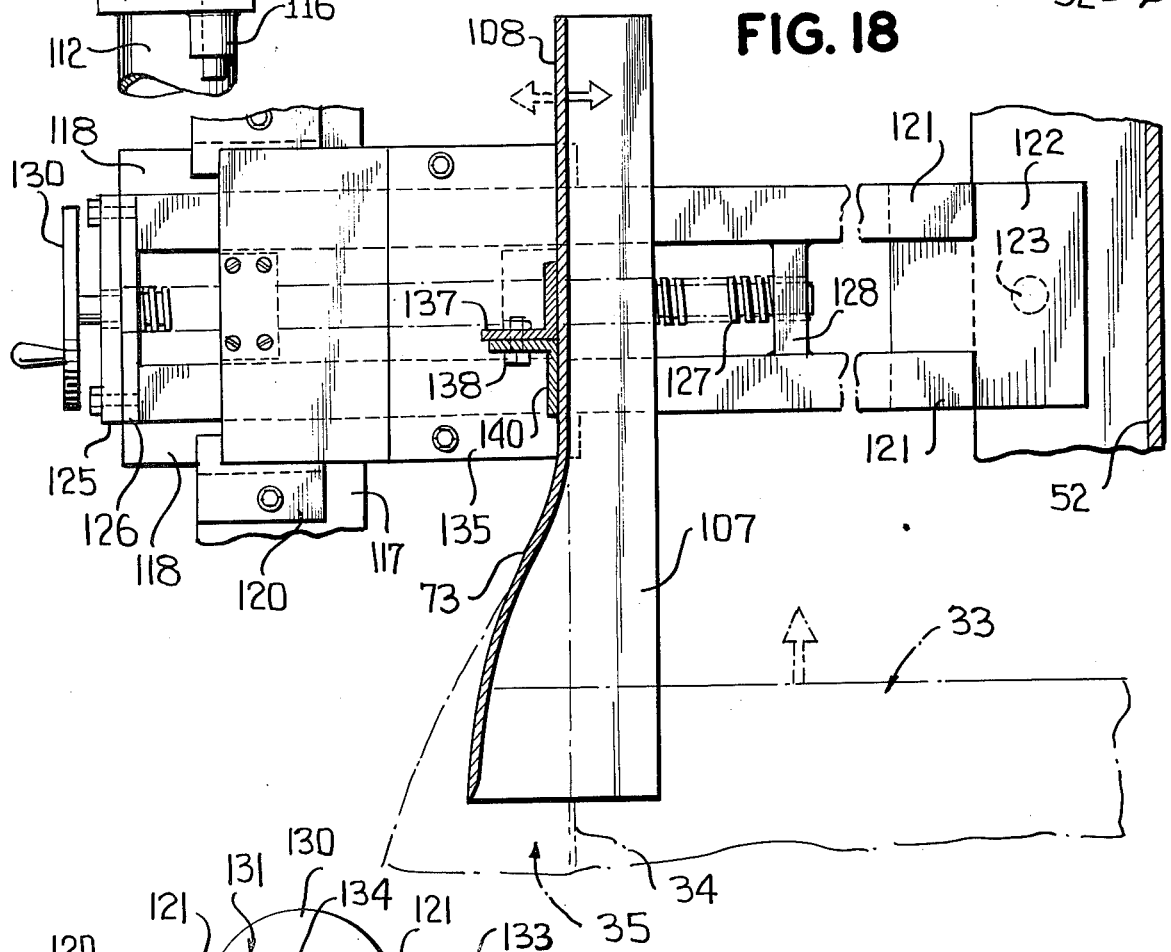
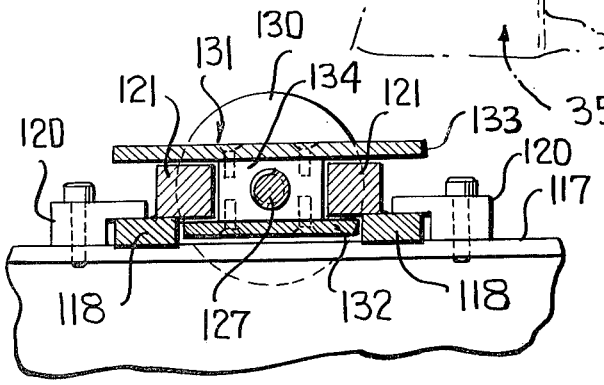
FIG. 19

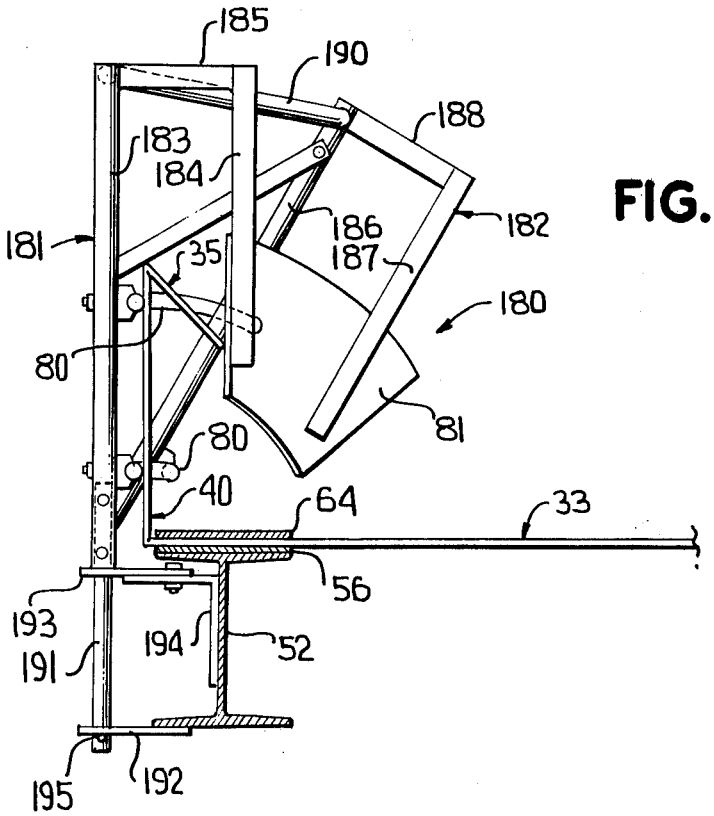
FIG.22
FIG.23
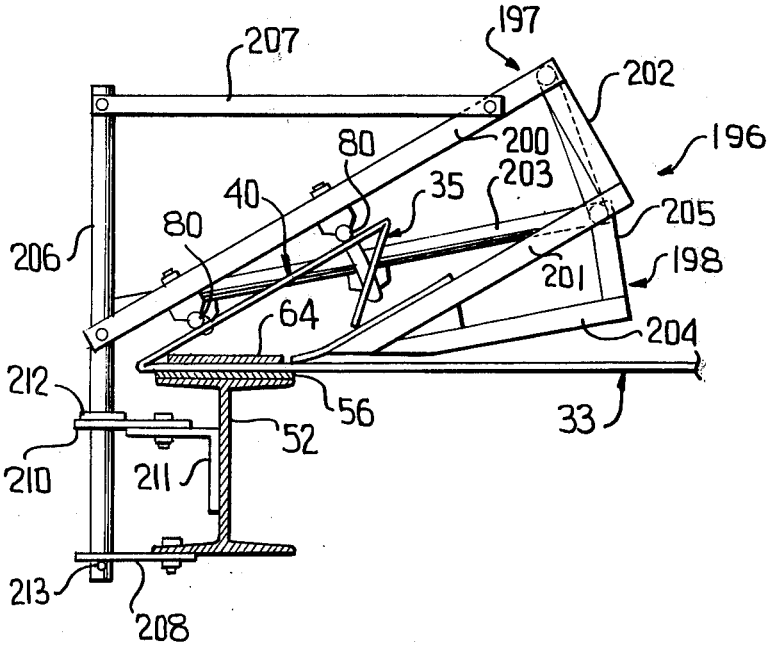

CARTON FORMING APPARATUS

This invention relates in general to new and useful improvements in carton forming machines, and more particularly to a carton forming machine for automatically forming a carton from a flat blank, which carton is particularly constructed to form a vehicle fender wrap.

In accordance with this invention, there is provided a conventional carton blank which in the past has been hand folded and hand fed to a hot melt applicator for sealing and compressing notwithstanding the fact that there has been a demand for large quantities of such wrap or carton. In accordance with this invention there has been provided an apparatus or machine which will continuously receive carton blanks in spaced relation, and will automatically fold edge portions of the blank and seal the same to other portions of the blank to form a sleeve along one edge of the resultant carton or wrap.

One of the principal features of the invention is the provision of a folder which will fold an edge flap of the blank into overlapping relation with respect to an adjacent panel of the blank and thereafter while the folded relationship of the edge flap with respect to the adjacent panel is maintained, the adjacent panel is folded into overlying relation with respect to the remainder of the blank so that the edge flap eventually is engaged in face-to-face relation with respect to a portion of the blank to which an adhesive stripe has been applied.

A further feature of the invention is the revision of a folder for folding the edge flap of a carton blank, which folder includes a blade and first and second plows, each of which is mounted for independent adjustment so as to compensate for selected variations in carton blank width and edge flap width.

Another feature of this invention is to provide a folder which includes a folding portion and a retaining portion so that a carton panel having an edge flap folded into overlapping relation with respect thereto may be readily folded into overlying relation with respect to an adjacent carton blank portion while the folded flap is held in its overlapping relation. Additionally, this folder is so constructed wherein it is mounted in sections and the sections are so mounted so as to be readily removable.

Another feature of the apparatus is the formation of a simple frame construction including two elongated beams functioning as frame rails and therebeing associated with those beams suitable conveyors for effecting the controlled feeding of the blank as it is being folded.

Another feature of the invention is the provision of an outfeed conveyor which overlies the folded carton in overlying relation to the folded edge flap thereof and the adhesive stripe underlying the edge flap so as to assure proper engagement of the edge flap with respect to the adhesive stripe.

The apparatus also includes a transverse takeaway conveyer which has associated therewith incorporating other conveyors. One of these other conveyors overlies the central portion of the takeaway conveyor for effecting the compressing of the folded carton and is mounted by means of an overhead support in a manner wherein it may be readily lifted upwardly with respect to the takeaway conveyor to an out of the way position.

Finally, there is associated with the takeaway conveyor a final compression conveyor which includes disks positioned for compressibly engaging the ends of the folded carton to assure the retention of the folded carton in its folded condition unless use thereof is required.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 12*a, b, c,* and *d* are plan views on a smaller scale of the carton blank showing the progressive stages of the folding thereof.

Figures 9, 10, 11, 12, 13:
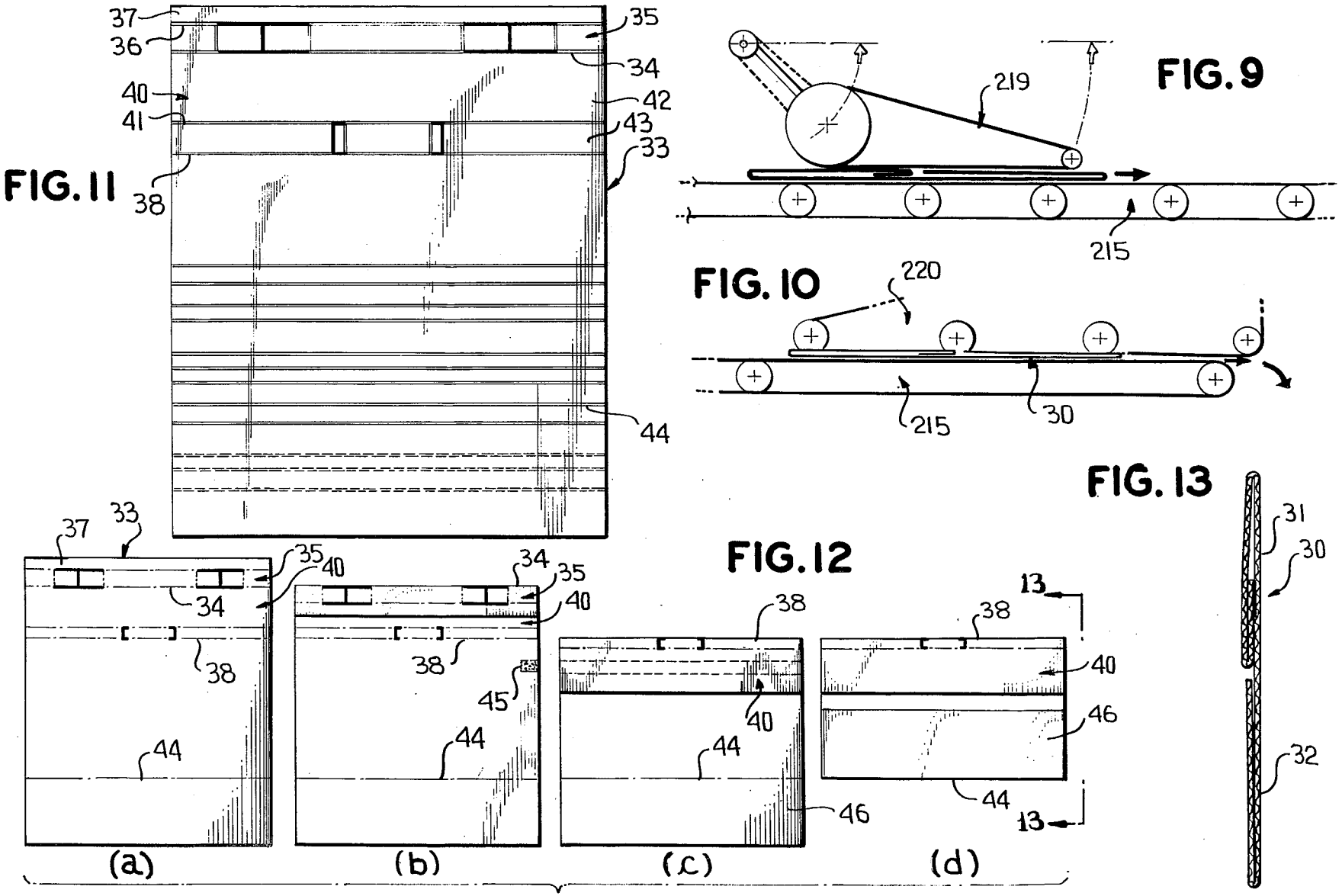
FIG. 9 is a schematic fragmentary side-elevational view of a takeaway conveyor and associated overlying conveyor for compressing the folded carton during the feeding thereof.
FIG. 10 is a diagrammatic side-elevational view of the takeaway conveyor of FIG. 9 at the opposite end thereof and shows a further combined feeding and folded carton compressing conveyor.
FIG. 11 is a plan view of the blank which is being folded.

FIG. 13 is an enlarged end elevational view of the folded carton.

Figure 4:
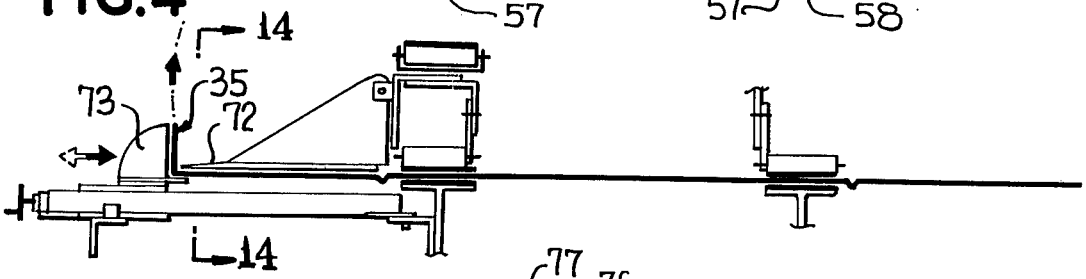
FIG. 4 is a schematic transverse sectional view similar to FIG. 3 and shows the function of a first plow to initiate folding of an edge flap.
Figure 14:
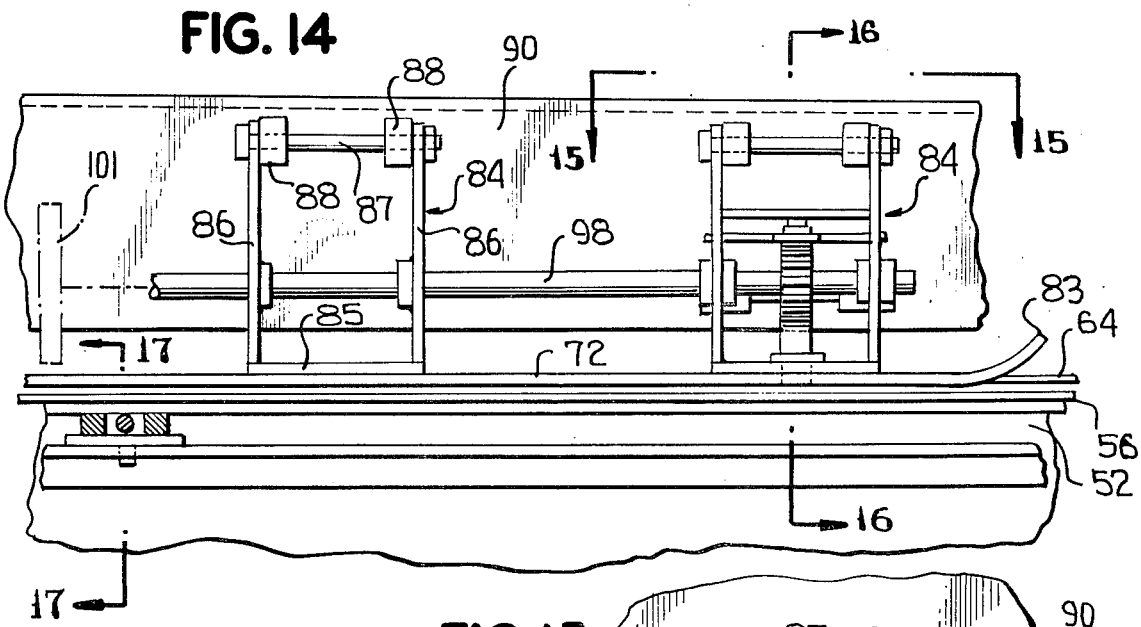

FIG. 14 is an enlarged fragmentary longitudinal vertical sectional view taken along the line 14—14 of FIG. 4 and shows the mounting of the blade.

Figure 15:
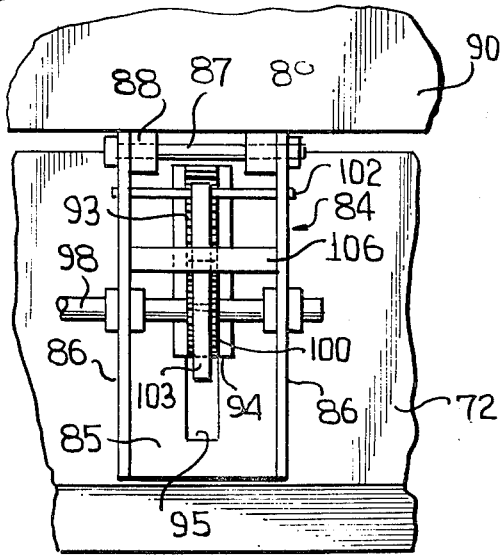

FIG. 15 is an enlarged fragmentary top plan view taken generally along the line 15—15 of FIG. 14 and shows further details of the blade adjustment.

Figure 16:
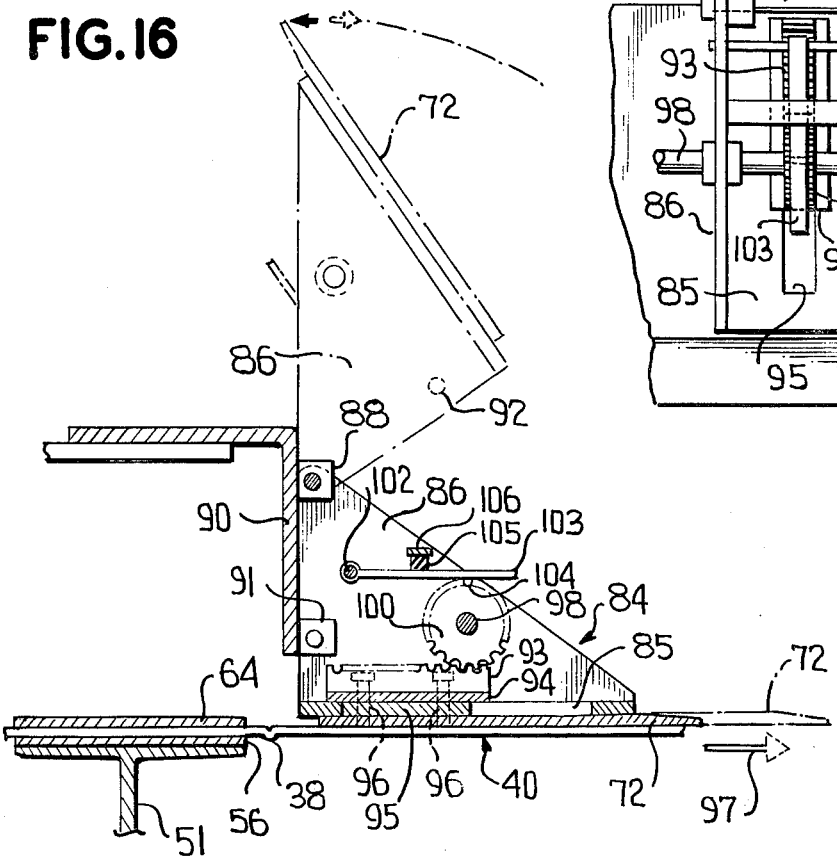

FIG. 16 is a fragmentary transverse vertical sectional view taken along the line 16—16 of FIG. 14 and shows further the mounting of the blade.

FIG. 17 is an enlarged fragmentary transverse vertical sectional view taken along the line 17—17 of FIG. 14 and shows the manner in which a first plow is adjustably mounted.

FIG. 18 is a fragmentary horizontal sectional view taken along the line 18—18 of FIG. 17 and further shows the adjustable mounting of the plow.

FIG. 19 is a fragmentary longitudinal vertical sectional view taken along the line 19—19 of FIG. 17 and additionally shows details of the plow adjustment.

FIGS. 20, 21, 22, and 23 are transverse vertical sectional views on a large scale taken through the apparatus and show in elevation the construction and mounting of the individual sections of the second folder.

Figures 24, 25, 26:
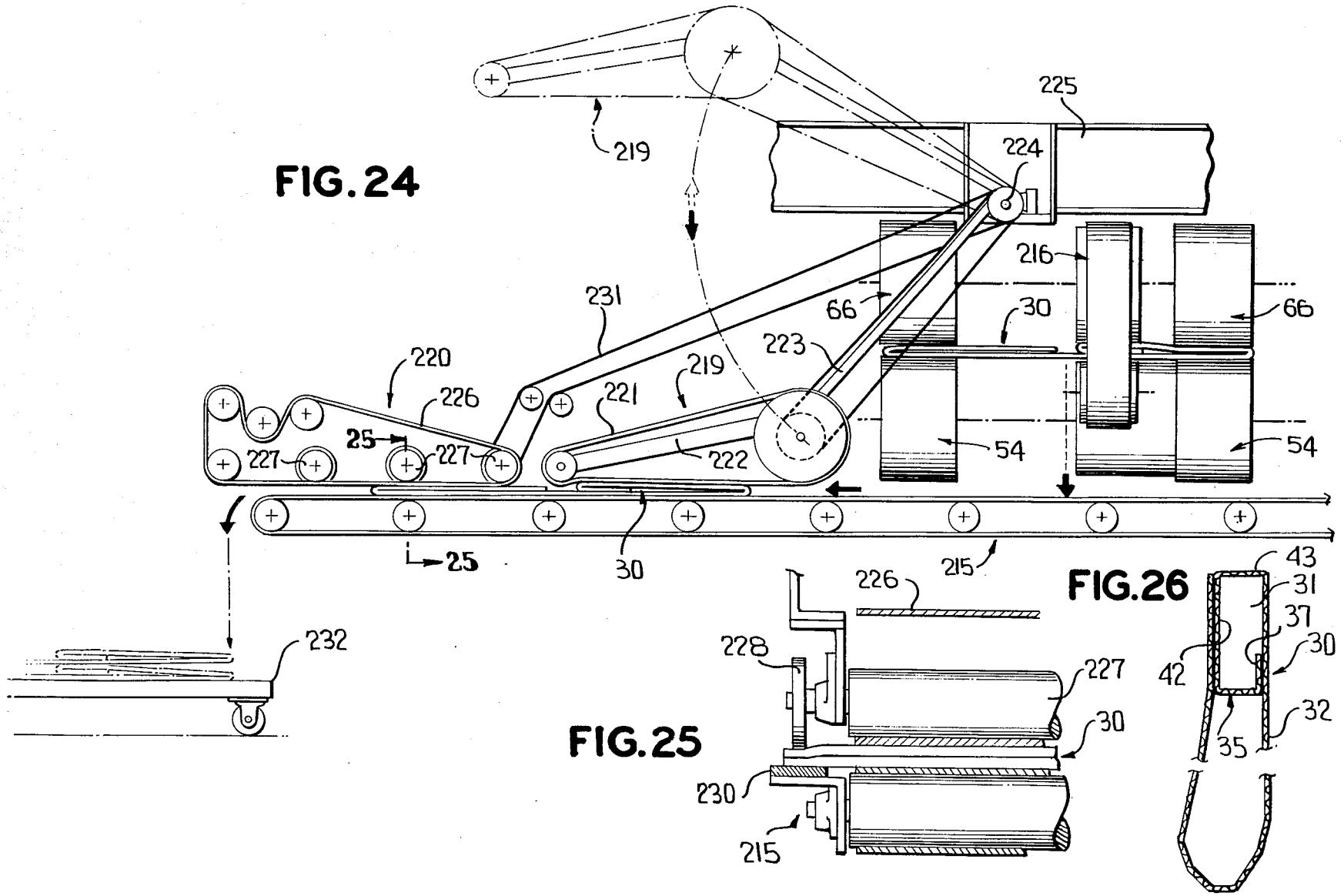

FIG. 24 is an enlarged diagrammatic side elevational view showing more specifically the details of the takeaway conveyor, the relationship thereof to the discharge end of the folding apparatus and the relation to a receiver for folded cartons.

FIG. 25 is a fragmentary vertical sectional view taken along the line 25—25 and shows more specifically the details of means for compressing a folded carton, particularly the ends thereof.

FIG. 26 is a sectional view taken through the final carton in its opened form ready to receive a vehicle fender.

Referring now to the drawings in detail, reference is first made to FIG. 26 wherein the cross sectional details of a final fender wrap or carton, generally identified by the numeral 30, is illustrated. The carton 30 is provided along one edge thereof with a generally rectangular cross sectional sleeve 31 and the remainder of the carton body 32 extends downwardly from the sleeve 31 and back up again with the remote edge of the carton being secured to the sleeve 31 in the final form of the carton. No attempt has been made to illustrate the position of a fender within the wrap 30.

Referring now to FIG. 13, it will be seen that the fender wrap 30 is illustrated in its constructed, folded form. The fender wrap 30 in this form is suitable for storage and shipment. The sleeve 31 is relatively flat and the remainder of the wrap 32 is folded flat upon itself.

Reference is next made to FIG. 11 wherein a blank, 33, from which the fender wrap 30 is formed, is illustrated. Inasmuch as neither the finished fender wrap 30 nor the blank 33 form a specific part of the invention, only those portions of the blank 33 specifically relating to the apparatus which is the subject of the invention, will be described in detail. The blank 33 includes a transverse fold line 34 which defines an edge flap 35. The edge flap 35 is further provided with a fold line 36 which sets off a glue flap 37.

The blank 33 also includes a fold line 38 which, together with the fold line 34, defines an adjacent panel 40. The panel 40 is provided with a fold line 41 which permits the later folding of the panel 40 to define panels 42 and 43, the panel 43 being of a width substantially equal to the width of the flap 35 between the fold lines 34 and 36 so as to permit the rectangular outline of the fender wrap 30, as shown in FIG. 26.

The blank 33 is provided with a plurality of additional fold lines for the purpose of readily conforming the carton portion 32 to conform to the configuration of a fender which is to be incorporated within the carton or or fender wrap 30. These fold lines include a fold line 44 about which the blank 34 is folded so as to reduce the size of the folded fender wrap 30 for shipment, as is clearly shown in FIG. 13.

In FIGS. 12*a, b, c,* and *d* there is schematically illustrated the steps of folding the blank 33 into the final carton or fender wrap 30. Starting with the flat blank 33 in FIG. 12*a,* a first folding occurs along the fold line 34 with the flap 35 being folded to a position overlapping the panel 40 as shown in FIG. 12*b.* Then after an adhesive stripe 45 is applied, as shown in FIG. 12*b,* the blank is folded along the fold line 38 so that the panel 40 overlies the remainder of the blank 33 and the glue flap 37 is presented to the remainder of the blank in overlying relation to the glue or adhesive stripe 45. This condition is shown in FIG. 12*c* and is in accordance with the illustration of FIG. 13.

The blank is also folded along the fold line line 44 so that a terminal panel 46 defined by the fold line 44 is folded into overlying relation with respect to the central portion of the blank, as shown in FIG. 12*d.* The folded carton is now completed and has the cross sectional appearance as shown in FIG. 13.

Figure 1:
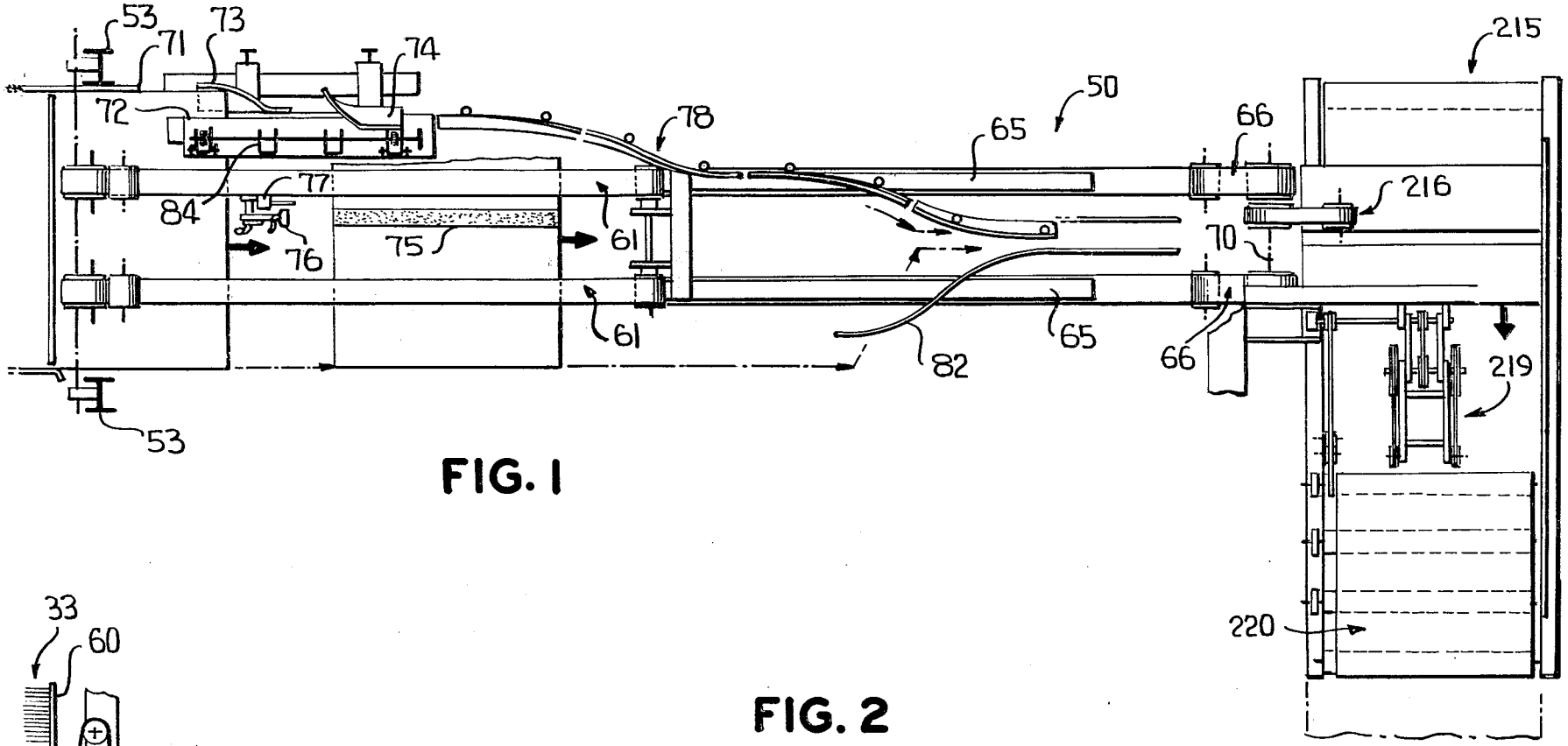
FIG. 1 is a diagrammatic plan view of the apparatus showing the relationship of the various components thereof.

Having described the fender wrap or carton which is to be formed and the blank from which it is formed, reference is now made to the apparatus for automatically folding the carton blank to form the folded carton of FIG. 13. The overall details of the apparatus is illustrated in FIG. 1 and the apparatus is generally identified by the numeral 50. The apparatus 50 includes a suitable frame which includes a pair of longitudinally spaced frame rails 51, 52 (FIG. 3) which are suitably supported in an elevated position by means of uprights, including uprights 53.

Figure 3:
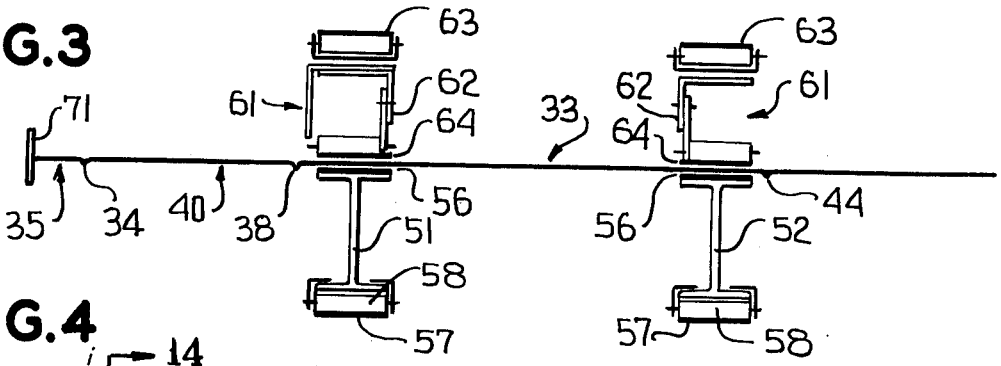
FIG. 3 is a diagrammatic transverse sectional view on a large scale through the apparatus at the head end thereof.

Passing around each of the frame rails 51, 52 is an endless conveyor belt 54 which is entrained about rollers 55 at the opposite ends of the frame rails, one of the rollers being a driven roller. Each conveyor 54 includes an upper run 56 which slides directly on the upper surface of the respective frame rail 51, 52, as is best shown in FIG. 3. The lower or return run 57 of each conveyor 54 rides on longitudinally spaced rollers 58. Overlying the left ends of the frame rails 51, 52, is conventional apparatus 60 for stacking blanks 33 and feeding the blanks 33 one at a time onto the upper runs 56 of the conveyors 54.

Immediately downstream of the carton feed apparatus 60 and disposed in overlying relation to the frame rails 51, 52 are a pair of conveyor assemblies generally identified by the numeral 61. Each conveyor assembly 61 includes a frame member 62 which is carried by the frame of the apparatus 50 in cantilevered overlying relation with respect to each of the frame rails 51, 52. A suitable roller arrangement is carried by the frame member 62 for supporting an endless conveyor member 63 which has a lower run 64 opposing each of the upper runs 56. Thus a carton blank fed into the apparatus 50 is gripped between the conveyor runs 56 and 64, as shown in FIG. 3, and is moved longitudinally along the apparatus 50.

Figure 2:
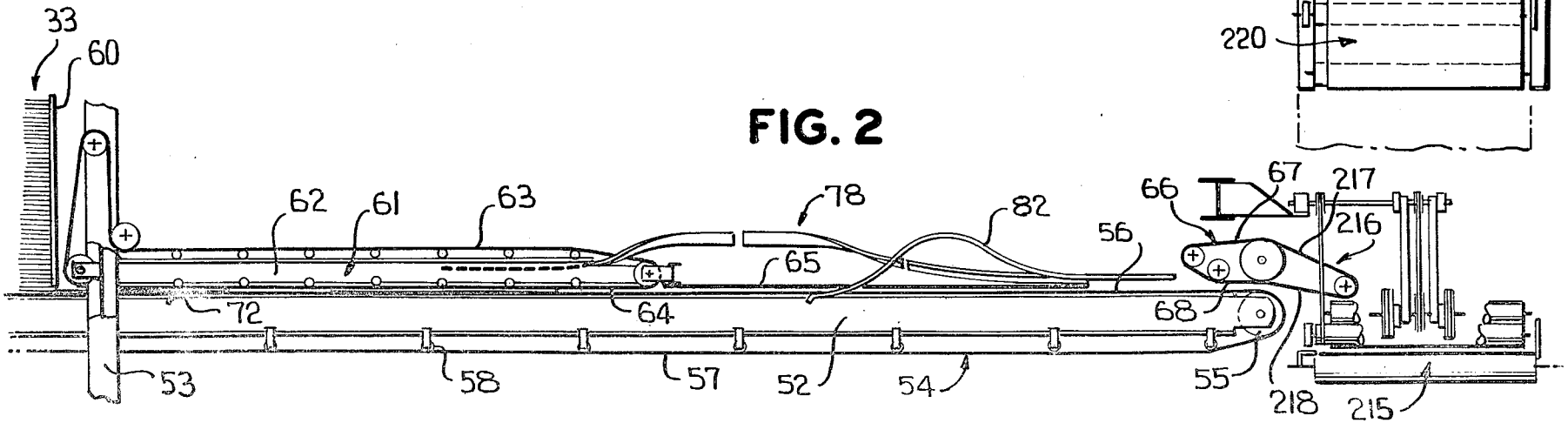
FIG. 2 is the side elevational view of the apparatus of FIG. 1.

As is best shown in FIG. 2, the conveyor apparatus 61 extend only approximately half the length of the frame rails 51, 52 beyond the supports 53. Carried by each frame member 62 is an elongated hold down member 65 which, in the absence of a carton blank, will rest on the conveyor upper runs 56. The hold down member 65 is in the form of an elongated strap-like element, as is clearly shown in FIG. 1.

Figure 8:
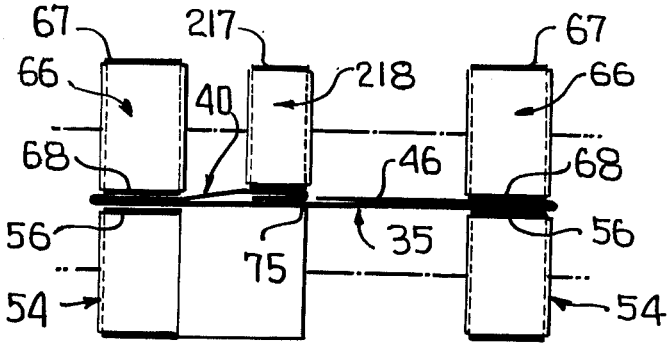
FIG. 8 is a schematic transverse sectional view through a discharge portion of the apparatus.

At the right ends of the frame rails 51, 52 and spaced from the hold down member 65 are final conveyors 66. Each final conveyor 66 includes an endless conveyor member 67 having a lower run 68 overlying a respective conveyor upper run 56 and cooperating therewith to feed the folded carton 30 out of the apparatus, as is shown in FIG. 8. The conveyors 66 are provided with a common drive shaft 70, as shown in FIG. 1.

As the carton blank 33 is fed into the apparatus, the left edge thereof is engaged with a side guide 71 to maintain alignment of the carton blank with the apparatus. Then, the carton blank passes beneath a folder blade 72 which has an outer edge positioned with respect to the fold line 34 so as to facilitate the folding thereof by means of a plow 73. The plow 73, in cooperation with the blade 72, as is shown in FIG. 4, folds the carton blank 33 about the fold line 34 so as to fold the edge flap 35 to an upstanding position, as shown in FIG. 4.

Figure 5:
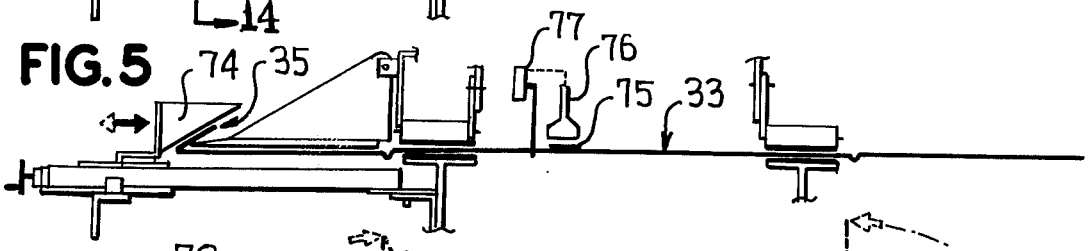
FIG. 5 is a sectional view similar to FIG. 4 and shows the function of a second plow to further fold the edge flap.

As the carton blank 33 moves along the apparatus 50, the edge flap 35 is folded back over the adjacent carton panel 40 by means of a second plow 74, as is best illustrated in FIG. 5. At this time a glue or adhesive stripe 75 is applied to the upper surface of the carton blank 33 by means of a conventional glue applicator 76, the actuation of which is controlled by means of a switch 77 in a conventional manner.

The structural details in the mounting of the blade 72 and the plows 73 and 74 will be set forth hereinafter. It is to be understood that the blade 72 and the plows 73 and 74 may be considered to be a first folder in that they function to fold the flap 35 about the fold line 34.

The carton blank 33, with the edge flap 35 in its folded state overlapping the carton panel 40 is then directed into a multi-section second folder 78. The second folder 78 includes a pair of rails 80 which underlie the panel 40 and which progressively turn first to an upstanding position, as shown in the righthand part of the diagrammatic illustration of the folder 78 in FIG. 6, and then to a position generally overlying the central portion of the carton blank 33, as is shown in the right-hand part of the folder 78 in FIG. 7. Associated with the rails 80 is a retainer 81 which is in the form of a plate. The plate 81 is aligned with the edge flap 35 and is spaced relative to the rails 80 so as to retain the edge flap 35 in its folded state relative to the panel 40 at all times during the folding of the panel 40 about the fold line 38.

Figure 7:
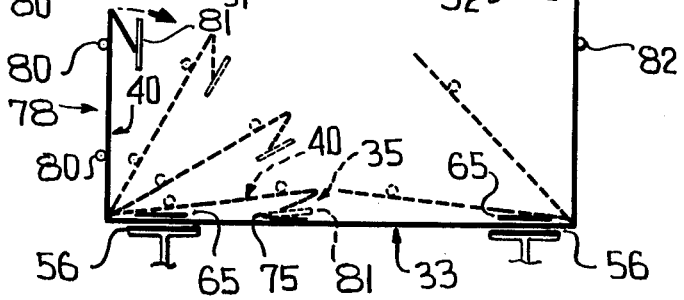
FIG. 7 is a sectional view similar to FIG. 6 and shows the further folding of the adjacent panel and the retention of the edge flap.

As will be apparent from FIG. 7, the retainer 81 approaches the adhesive stripe 75, but terminates short of touching the same. The retainer 81 then stops and the panel 40 is further moved towards the central portion of the blank 33 by a continuation of at least the innermost folder rail 80 until the panel 40 is brought substantially into engagement with the central portion of the blank 33 and the glue flap 37 of the edge flap 35 is brought into engagement with the glue or adhesive stripe 75.

Figure 6:
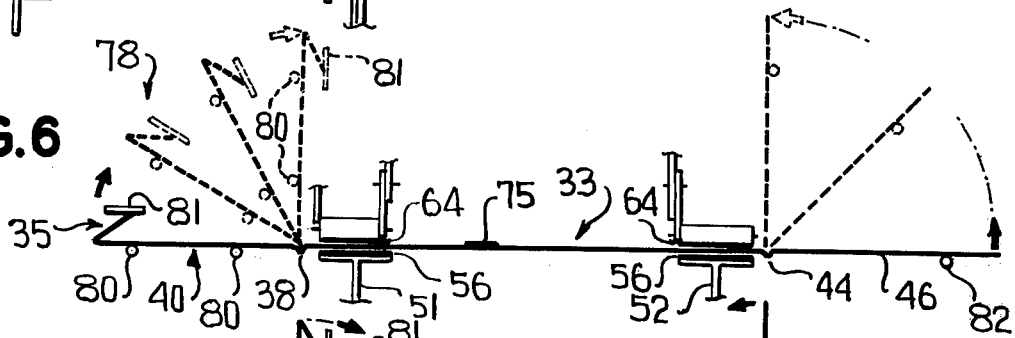
FIG. 6 is a schematic sectional view taken through another folder section of the apparatus and shows the manner in which an adjacent carton panel is folded while retaining the edge flap in its folded shape.

The apparatus 50 also includes a folder rail 82 disposed along the right side of the apparatus, as shown in FIG. 1. The folder rail 82 serves to fold the panel 46 about the fold line 44 from the plane of the blank 33 to a position overlying the blank, as is schematically shown in FIGS. 6 and 7. At this time, it is pointed out that the folder rail 82 will normally have a starting end at a position wherein the folder 78 has already folded the panel 40 to its upright position of FIG. 6. However, FIGS. 6 and 7 being diagrammatic views, liberty has been taken to show the folder rail 82 as functioning in FIG. 6.

Referring now to FIGS. 14 through 16, the details of the folder blade 72 and the mounting thereof are illustrated. First of all, it will be seen that the folder blade 72 has a curved leading portion 83 to facilitate the movement of a carton blank 33 therebeneath. Secondly, as is shown in FIG. 1, the folder blade 72 is carried by four longitudinally spaced supports 84. Each support 84 includes a base plate 85 and two triangular outline sideplates 86. The upper corners of the sideplates 86 of each support 84 have extending therethrough an elongated mounting bolt 87 which, in turn, is journaled in a pair of blocks 88 projecting outwardly from the side of a frame member 90. The frame member 90 also has second blocks 91 associated with at least one of the supports 84 for the reception of retaining pins passable through openings 92 in the sideplates 86 of the support, as shown in FIG. 16. Thus, the blade 72 may be readily swung to an out of the way position, as shown in FIG. 16 to clear jams and to facilitate access to other parts of the apparatus 50. At least the endmost ones of the supports 84, and, if desired, all of the supports 84, are provided with racks 93 which are secured in overlying relation to plates 94 which are seated on the base plates 85. Each base plate 85 which has associated therewith a rack 93 is provided with a longitudinal slot 95 in alignment with the rack 93. The folder plate 72 underlies the base plates 85 and is secured to the racks 93 by means of fasteners 96 which extend through the slot 95. Thus the folder plate 72 may be extended from its retracted position of FIG. 16 in the direction of the arrow 97 to an extended position as shown in dotted lines.

In order to accomplish the adjustment of the position of the folder blade 72, a longitudinal shaft 98 extends through the supports 84 and is rotatably journaled therein. Carried by the shaft 98 in alignment with each rack and engaged with the rack is a pinion 100. At one end of the shaft 98 is a hand wheel 101 for rotating the shaft 98 to rotate the pinions 100 and thus advance or retract the racks 93 and the blades 72.

In order that the blade 72 may be retained in an adjusted position, at least one of the pinions 100 has associated therewith a detent mechanism for preventing the accidental rotation of the pinion. This detent mechanism includes a rod 102 which extends between the respective sideplates 86 and carries an arm 103 which overlies the pinion 100 and is provided with a detent tooth 104 which is engagable between adjacent teeth of the pinion 100. The detent tooth 104 is resiliently held in engagement with the teeth of the pinion 100 by means of a resilient block 105 which overlies the arm 103 and is carried by a bar 106 extending between the sideplates 86. It is to be understood that the resilient block 105 has sufficient resiliency such that when the shaft 98 is manually turned by way of the hand wheel 101 the detent tooth 104 and the arm 103 carrying the same can move upwardly permitting the rotation of the pinion 100.

At this time it is pointed out that the folder blade 72 is transversely adjustable so as to compensate for the varying widths of the edge flap 35. In order to also compensate for the varying width of the edge flap 35, it is necessary that the plows 73 and 74 be adjustably mounted. Since the mounting of the plows 73 and 74 is identical, the mounting of only the plow 73 will be described in detail here.

Reference is now made to FIGS. 17–19 wherein the details of the mounting of the plow 73 are illustrated. First of all, the plow 73 is of an L-shaped configuration and includes a horizontal blade portion 107 and an upstanding blade portion 108 which progressively turns from a generally horizontal position to a vertical position as shown in FIG. 17.

It is next pointed out here that the plow 73 is readily removable. The plow is carried by an angle frame member 110 secured to the frame rail 52 and by a plate 111, spaced outwardly of the frame rail 52 and carried by suitable vertical supports 112. The plow 73 is most particularly carried by a support which includes an angle member 113 having a vertical flange 114 seated on the plate 111 and carrying pins 115 which pass through apertures in the plate 111 and are received in sockets 116 underlying the plate 111. The angle member 113 also includes a horizontal flange 117 to which is clamped a pair of transversely extending rails 118 by means of hold downs 120. The rails 118, in turn, are suitably secured, such as by welding, to a pair of bars 121 which have their right hand ends secured to a plate 122 which overlies the frame member 110. The plate 122 is provided with a pin 123 which extends through an opening 124 in the frame member 110.

Longitudinally extending straps 125, 126 extend across the ends of the bars 121 and the end of the feed screw shaft 127 is rotatably journaled in the straps 125, 126. The inner end of the shaft 127 is rotatably journaled in a strap 128 extending between inner portions of the bars 121. The other end of the shaft 127 is provided with a hand wheel 130.

A carriage 131 is carried by the bars 121. As shown in FIG. 19, the carriage includes a lower plate 132 and an upper plate 133 with the plates 132, 133 being connected together along opposite edges thereof by blocks 134. The shaft 127 passes through the blocks 134 and at least one of the blocks 134 is internally threaded so as to function as a feed nut for the carriage 131 so that when the shaft 127 is rotated, the threads thereof will effect feeding of the feed nut and the resultant feeding of the carriage 131.

Overlying the carriage 131 at the inner end thereof is a plate 135 which is secured to the plate 133 by fasteners 136. In turn, an upstanding angle member 137 is secured to the plate 135, as by welding, and to this plate there is releasably secured by fasteners 138 a leg of an angle member 140 which is upstanding and which is welded to the plow 73.

As stated above, and as is clearly shown in FIG. 1, the plow 74 is adjustably and removably mounted in the same manner as the plow 73.

Figure 20:
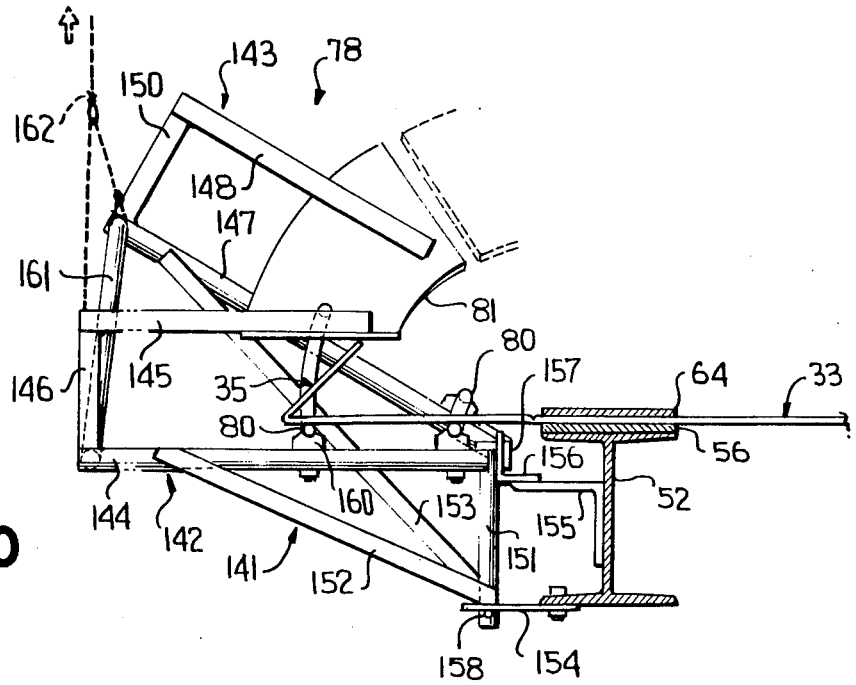

As was previously described, the folder 78 is formed in sections. By so constructing the folder 78, it may be readily removed from the apparatus. In the preferred embodiment of the invention, the folder 78 has been formed in four sections, although the number of sections may be varied as to size. In FIG. 20, a first of these sections, section 141, is illustrated. Adjacent opposite ends of the section 141 are supports 142, 143. The support 143 includes parallel frame members 144 and 145 which are interconnected at their early ends by a connecting member 146. The support 143 also includes parallel frame members 147, 148 connected together at their outer ends by a connecting member 150. It will be seen that the relationship of frame members and connecting members are identical at the two supports.

The inner end of the frame member 144 is connected to a vertical pin 151 and is braced by means of a diagonal brace 152 which extends from a lower portion of the pin 151 to an outer portion of the frame member 144. It is to be understood that a similar pin, not shown, has secured thereto the inner end of the frame member 147 and there is a diagonal brace 153 extending from the lower end of the second pin to the other portion of the frame member 147.

The pins 151 serve to detachably mount the folder section 141 on the frame rail 52. To this end, secured to the lower part of the frame rail 52 in transverse alignment with each of the pins 151 is a plate 154. There is also an angle member 155 secured to the intermediate part of the frame rail 52 with the angle member 155 having an upper horizontal flange which, in turn, carries a smaller angle member 156. The upper part of the pin 151 carries a small angle bracket 157 which interlocks with the angle member 156 in the manner illustrated in FIG. 20 whereas the lower end of the pin 151 extends through an aperture in the plate 154. The lower part of the pin 151 may be provided with a retaining pin 158 disposed below the plate 154 to prevent removal of the pin 151.

It is to be noted that the folder rails 80, which are curved, are secured to the respective frame members 144, 145 by means of saddle type supports 160. On the other hand, the retainer 81 is in the form of an elongated strap or plate which is also curved and which is directly secured to the undersides of the frame members 145, 148. The other ends of the frame members 144, 145 are connected together by means of a longitudinal frame member 161. Thus the section 141 is a readily handable unit.

When it is desired to remove the folder section 141, suitable lifting means 162 is attached thereto, as is diagrammatically illustrated, and the folder section is lifted off of the supports carried by the frame rail 52.

Figure 21:
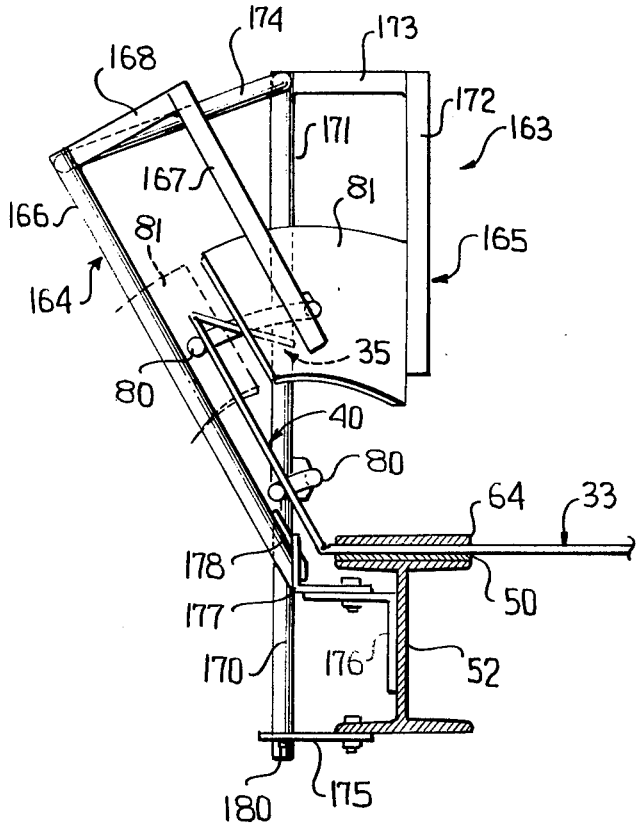

Reference is now made to FIG. 21 wherein a second folder section, generally identified by the numeral 163, is illustrated. The folder section 163 also includes a pair of longitudinally spaced supports 164 and 165 which are of a similar construction to the supports 142, 143. The support 164 includes parallel frame members 166, 167 which are connected together at their outer ends by connecting member 168. The inner end of the frame member 166 is secured to the upper end of a pin 170. In a like manner, the support 165 includes parallel frame members 171, 172 connected together at their outer ends by connecting member 173. The inner end of the frame member 171 is connected to the upper end of a pin identical to the pin 170. The outer ends of the frame members 166 and 171 are connected together by a longitudinally extending frame member 174.

The folder rails 80 are mounted on the frame members 166 and 171 in the same manner as that described with respect to the folder section 141. The retainer 81 is welded to the undersides of the frame members 167 and 172.

The folder section 165 is also detachably carried by the frame rail 52. The lower ends of the pins 170 are received in apertured plates 175 carried by the lower part of the frame rail 52 while the upper part of each pin 170 is carried by an angle member 176 which, in turn, has an angle member 177 secured thereto. The upper end of each pin 170 is provided with an angled strap 178 which interlocks with the angle member 177. Each pin is retained in place by a retaining pin 180 in the lower portion thereof.

Reference is now made to FIG. 22 wherein a third folder section, generally identified by the numeral 180, is illustrated. The same construction details utilized in the folder sections 141 and 164 are utilized in the folder section 180. The folder section 180 includes two longitudinally spaced supports 181 and 182 for the folder rails 80 and the retainer 81. The support 181 includes spaced frame members 183 and 184 connected together by a connector member 185. In a like manner, the support 182 includes parallel frame members 186 and 187 connected together by a connector member 188. The outer ends of the frame members 183, 186 are connected together by a longitudinally extending frame member 190.

The lower ends of the frame members 183 and 186 are connected to vertical pins 191. The lower ends of the pins 191 extend through apertures in plates 192 secured to the underside of the frame rail 52. The upper portion of each pin 191 passes through an apertured plate 193 which is carried by an angle member 194 secured to the web of the frame rail 52. The ends of the frame members 183 and 186 abut the upper surface of plate 193 to vertically position the section 180. The pins 191 are retained against withdrawal by removable retaining pins 195.

The folder rails 80 are secured to the frame members 183 and 186 in the same manner as previously described while the retainer 81 is welded to the undersides of the frame members 184 and 187.

Reference is now made to FIG. 23 wherein the fourth folder section, generally identified by the numeral 196, is illustrated. The fourth folder section 196 also includes a pair of longitudinally spaced supports 197 and 198. The support 197 includes a pair of parallel frame members 200 and 201 joined at the outer ends by a connecting member 202. In a like manner, the support 198 includes a pair of parallel frame members 203 and 204 connected together at their outer ends by a connecting member 205.

The support 197 is carried by a vertical pin 206 which is elongated and which has the lower end of the frame member 200 connected to an intermediate portion thereof. A brace 207 extends from the upper end of the pin 206 to a point adjacent the outer end of the frame member 200. The lower end of the pin 206 extends through an apertured plate 208 carried by the lower part of the frame rail 52 whereas the lower portion of the pin 206 extends through an apertured plate 210 carried by an angle member 211 secured to the web of the frame rail 52. Downward movement of the pin 206 is limited by means of a collar 212 which engages the upper surface of the plate 210. Withdrawal of the pin 206 is restricted by means of a retaining pin 213. A similar pin, mounted in a similar manner, has secured to the upper end thereof the lower end of the frame member 203.

At this time it is pointed out that the folder rails 80 as secured to the frame members 200 and 203 in the manner described with respect to the other folder sections, while the retainer 81 is secured to the frame members 201 and 204 by welding in the same manner as described with respect to the other folder sections.

At this time it is pointed out that the folder rail 82 may be mounted in any conventional manner.

Reference is once again made to FIG. 1 wherein it will be seen that the apparatus 50 also includes a takeaway conveyor, generally identified by the numeral 215. The takeaway conveyor 215 extends transversely of the frame rails 51, 52 and is adapted to receive a completely folded carton as shown in FIG. 13. In addition to the carton being delivered to the takeaway conveyor 215 by the conveyors 54 and 66, there is also an outfeed conveyor, generally identified by the numeral 216. The outfeed conveyor 216, as best shown in FIG. 2, includes an endless conveyor 217 having a lower run 218 which slopes downwardly towards the takeaway conveyor 215. As is best shown in FIG. 1, the outfeed conveyor 216 is in longitudinal alignment with the glue applicator 76 so that, as shown in FIG. 8, the outfeed conveyor 216 engages the upper surface of the folded carton in alignment with the glue stripe 75. As is best shown in FIGS. 1, 9, 10 and 24, the takeaway conveyor 215 has associated therewith in overlying relation with respect thereto two further conveyors, generally identified by the numerals 219 and 220. The conveyor 219 includes two spaced conveyor belts 221 which are suitably married on pulleys or rolls and which engage the central portion of each folded carton 30 in the manner illustrated in FIGS. 1 and 24. The conveyor 219 includes a frame 222 which is carried by an arm 223 which, in turn, is mounted for pivotal movement on a shaft 224 carried by a frame member 225, as is best illustrated in FIG. 24. The relationship of the frame member 222 and the arm 223 is such that the conveyor 219 may be readily moved to an elevated out of the way position, as is clearly shown in FIG. 24. The conveyor 220, in addition to facilitating the movement of a folded carton 30 by the takeaway conveyor 215, is also a final compressing conveyor which functions to tightly compress the folded carton 30 and retain the same in a flat state. The conveyor 220 includes an endless conveyor belt 226 which passas around supporting rolls one of which will be driven. These rolls include three lower rolls 227 which are particularly cooperable with the takeaway conveyor 215 so as to compress the folded carton 30 therebetween, as is clearly shown in FIG. 25. Further, with respect to FIG. 25, it is to be noted that associated with each of the rolls 227 is a disk 228 disposed at each end of a roll 227. The disk 228 is of a larger diameter than the roll 227 and cooperates with a plate 230 of the takeaway conveyor 215 to crushingly compress the folded carton 30 along opposite ends thereof.

At this time it is pointed out that the conveyors 219 and 220 are commonly driven, there being a drive belt connection 231 between the two conveyors.

It is also pointed out here that folded cartons 30 passing off of the takeaway conveyor 215 may be passed through any desired type of receptacle. There is illustrated in FIG. 24 a wheeled platform 232 for receiving such folded cartons.

From the foregoing, it will be readily apparent that there has been developed a practical and relatively simple apparatus for automatically forming a large fender wrap or carton in a folded state ready for use but in condition for shipment and storage, which carton in the past has been hand formed at a relatively great cost.

Although a preferred embodiment of the apparatus has been specifically illustrated and described herein, it is to be understood that minor variations may be made in the apparatus without departing from the spirit and the scope of the invention, as defined by the appended claims.

I claim:

1. Apparatus for automatically folding a prescored carton blank and forming a carton therefrom wherein the carton is of the type having a longitudinal sleeve at one edge thereof, said apparatus comprising feed means for continuously feeding a prescored carton blank longitudinally along a predetermined path, said feed means extends longitudinally along said path, first folder means along one side of said path for engaging an edge flap and a first score line of a carton blank progressively to effect the folding of the edge flap along the first score line to produce an overlapping spaced relation between the edge flap and an adjacent panel of the blank, adhesive applying means positioned along said path for applying a stripe of adhesive to an adjacent portion of the carton blank lying transversely inwardly of the adjacent panel, second folder means for folding the adjacent panel along a second score line to progressively effect the adjacent panel to move into overlying relation to the adjacent carton blank portion and to bring a portion of the edge flap into engagement with the adhesive stripe while holding the edge flap in its overlapping spaced relation to the adjacent flap.

2. Apparatus according to claim 1 wherein said feed means includes a conveyor overlying said path to assist in continuously feeding a blank along said path, and said feed means conveyor is positioned in longitudinal alignment with said adhesive applying means.

3. Apparatus according to claim 1 together with transverse feed means at an end of said path defining a transverse path for receiving and conveying folded cartons to a discharge area, said transverse feed means includes a conveyor extending longitudinally along said transverse path and having an upper run defining a folded carton support, and further conveyor means overlying said conveyor for cooperation therewith.

4. Apparatus according to claim 3 wherein said further conveyor means includes a second conveyor overlying the first mentioned conveyor and having overhead support means including means facilitating swinging of said second conveyor upwardly to an out of the way position.

5. Apparatus according to claim 3 wherein said further conveyor means includes a second conveyor overlying the first mentioned conveyor, said second conveyor including remote disks overlying remote edges of said transverse path for compressing end portions of cartons.

6. The apparatus as defined in claim 3 wherein said apparatus includes an outfeed conveyor lying in longitudinal alignment with said adhesive applying means, said outfeed conveyor overlying and and cooperating with said feed means to continuously convey a carton blank along said path, and said outfeed conveyor further overlying said transverse feed means to facilitate continual conveying of a folded carton from said feed means to said transverse feed means.

7. Apparatus according to claim 1 wherein said first folder means is of the cooperating blade and plow type, said first folder means including a first plow cooperating with said blade for folding an edge flap to an upstanding position and a second plow also cooperating with said blade for folding the same edge flap to an acute angle position relative to the remainder of a carton blank, each plow is mounted upon a separate bracket and includes means for effecting transverse adjustment thereof with respect to said path.

8. Apparatus according to claim 1 including a frame establishing said path, said frame including a pair of frame rails, said feed means including a first conveyor carried by each frame rail and defining a moving support for carton blanks, a second conveyor overlying each first conveyor and having a lower run cooperating with a respective first conveyor upper run, said second conveyors extending at least beyond said first folder means, a hold down strip overlying each first conveyor upper run beyond said second conveyor, each hold down strip being directly engaged with an associated first conveyor upper run in the absence of a carton blank, third conveyors overlying said first conveyors and said frame rails beyond said hold down strips, said third conveyors having lower runs directly cooperating with respective first conveyor upper runs, an outfeed conveyor positioned between said third conveyors and in cooperating relation with said first conveyors.

9. Apparatus according to claim 7 wherein a mounting bracket supports said blade in cooperating relation to said plows, and there are means mounting said mounting bracket to effect swinging movement of said blade to an out of the way position from said plows, and said mounting bracket includes adjusting means for effecting transverse adjustment of said cooperating blade with said plows to provide adjustment therebetween in order to accommodate carton blanks of varying widths.

10. Apparatus according to claim 8 wherein said outfeed conveyor is positioned in longitudinal alignment with said adhesive applying means.

11. The apparatus as defined in claim 1 wherein said second folder means includes folder element means engagable with the adjacent panel to effect the folding thereof and to provide support of the adjacent panel to minimize folding of the adjacent panel along a third score line disposed between the first and second score lines, and a retaining element opposing said folder element means for engaging an outermost edge of the edge flap and maintaining the edge flap in its overlapping spaced relation established by said first folder means until the edge flap portion engages the adhesive stripe.

12. The apparatus as defined in claim 11 wherein said second folder means is constructed of several adjacent sections lying in abutted relation with each other, each section includes respective support means for supporting said section longitudinally along said path, and each support means has independent mounting means to facilitate removal of each section from along said path.

13. The apparatus as defined in claim 12 wherein said apparatus includes a frame extending longitudinally along said path, siad mounting means depends said sections from said frame, and each mounting means includes at least two spaced pin and socket connections to facilitate removal of each section from said frame.

14. The apparatus as defined in claim 12 wherein at least one of said sections includes only said folder element means positioned to effectively bring the edge flap portion into engagement with the adhesive stripe.

* * * * *